US006296517B1

(12) United States Patent
Ito et al.

(10) Patent No.: US 6,296,517 B1
(45) Date of Patent: Oct. 2, 2001

(54) TERMINAL PROTECTIVE CAP

(75) Inventors: Takanori Ito; Takashi Suzuki; Satoshi Amihiro, all of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/577,043

(22) Filed: May 24, 2000

(30) Foreign Application Priority Data

May 27, 1999 (JP) ..... 11-147840

(51) Int. Cl.[7] ..... H01R 13/52
(52) U.S. Cl. ..... 439/521; 439/447
(58) Field of Search ..... 439/521, 522, 439/519, 367, 523, 801, 445, 447, 892, 893, 135, 136; 429/65; 174/138 F, 5 R

(56) References Cited

U.S. PATENT DOCUMENTS 2,800,522 * 7/1957 Coleman et al. ..... 439/521
3,914,529 * 10/1975 Holloway ..... 174/5 R
4,921,443 * 5/1990 Sato ..... 439/521
5,021,305 * 6/1991 Turner ..... 429/65
5,169,338 * 12/1992 Dewar et al. ..... 439/522
5,188,537 2/1993 Itoh et al. ..... 439/127
5,503,642 * 4/1996 Lippert et al. ..... 29/623.1

* cited by examiner

*Primary Examiner*—Paula Bradley
*Assistant Examiner*—Ross Gushi
(74) *Attorney, Agent, or Firm*—Greenblum & Bernstein, P.L.C.

(57) ABSTRACT

The present invention provides a terminal protective cap that covers a terminal of an electric wire and protects the terminal from exposure. The terminal protective cap has an engaging portion that engages with a projecting portion provided on an outer periphery of the terminal. This prevents the terminal from being exposed. Thus, the terminal is securely protected.

11 Claims, 6 Drawing Sheets

Prior Art

Prior Art

TERMINAL PROTECTIVE CAP

BACKGROUND OF THE INVENTION

1. Field of Invention

This invention relates to a terminal protective cap. In particular, this invention relates to a terminal protective cap that protects a terminal of an electric wire connected to electrical equipment of an automobile, such as a starter motor, from being exposed.

2. Description of Related Art

Generally, electrical equipment provided on an automobile and the like are connected by using wire harnesses. In particular, electric wires to be connected to electrical equipment, such as a starter motor, having a high voltage, are covered by a cap to prevent metal parts from being exposed, and thus, to prevent short circuiting of terminals connected to the starter motor.

FIGS. 4(*a*) through 5 illustrate an example of a conventional cap of this type. FIG. 4(*a*) shows an electric wire 1 and an terminal 1*a* of the electric wire 1. The terminal 1*a* is fixed to a starter motor by using a bolt. FIG. 4(*b*) shows a cap 2 that is made from a macromolecular material, such as EPDM. The terminal 1*a* is inserted into the cap 2, as shown in FIG. 5, to become a unit. Thus, the cap 2 covers the terminal 1*a*.

The cap 2 can be flipped over so that the terminal 1*a* is exposed. The terminal 1*a* is mounted to the starter motor by using a bolt when the cap 2 is flipped over. After mounting, the cap 2 covers the terminal 1*a* to protect the terminal 1*a* from outside.

However, with the conventional cap 2, there is no means to engage the cap 2 with the terminal 1*a*. Therefore, the cap 2 is sometimes inadvertently separated from the terminal due to vibrations of the starter motor or the like, and the terminal 1*a* is exposed to outside. Accordingly, the terminal 1*a* cannot be sufficiently protected and a short circuit may occur.

SUMMARY OF THE INVENTION

To resolve the problem described above, the present invention provides a terminal protective cap that prevents a terminal from being exposed and securely protects the terminal. The terminal protective cap covering a terminal of an electric wire has an engaging portion that engages with a projecting portion provided on an outer periphery of the terminal.

According to the features of the present invention, since the projecting portion of a terminal engages with an engaging portion of the terminal protective cap, the cap is prevented from being inadvertently separated due to an external factor, such as vibrations. Thus, the terminal is securely protected. Accordingly, the terminal is prevented from being exposed and from being short-circuit.

In another aspect of the present invention, the engaging portion of the terminal protective cap includes a hole in which the projecting portion is accommodated, and an opening is provided through which the projecting portion of the terminal is inserted into the hole. The opening is provided in the bottom surface of the engaging portion. The opening can be formed as a slot or a slit.

In this case, the projecting portion is inserted through the opening. In other words, the projecting portion can be inserted into the hole by pressing the engaging portion from the top when the cap is being mounted on the terminal. Thus, the operability of the mounting task of the cap improves.

In a further aspect of the present invention, there is provided a terminal protective cap that covers a terminal of an electric wire and protects the terminal from outside. The terminal protective cap has a hollow portion, a concave portion, and an engaging portion. The hollow portion has an opening at a proximal end thereof to receive the terminal. The concave portion is provided at a distal end of the hollow portion and has an opening at the bottom. The engaging portion is provided on an outer periphery of the concave portion and engages with a projecting portion provided on an outer periphery of the terminal.

According to the features of the present invention, the proximal part of the terminal is wrapped by the hollow portion, and a distal part of the terminal engages with the engaging portion of the terminal protective cap. Thus, the terminal is securely covered by the terminal protective cap.

In another aspect of the present invention, there is provided a method for mounting a terminal protective cap to a terminal. First, the terminal is inserted into the terminal protective cap. Then, an insertion aperture provided in the terminal is aligned with an opening portion provided in a bottom of the terminal protective cap. While the terminal protective cap is flipped over to expose the terminal, the terminal is fixed to an electric equipment. After the terminal protective cap covers the terminal, a top of an engaging portion of the terminal protective cap is pressed so that a projecting portion of the terminal passes through an opening provided in a bottom of the engaging portion and is accommodated in a hole provided in the engaging portion.

According to the features of the present invention, the operability of the mounting task of the terminal protective cap becomes simple.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein:

FIG. 2(*e*) is a bottom view illustrating another example of a shape of an opening provided in the bottom of the engaging portion.

DETAILED DESCRIPTION OF PREFERRED EMBODIMENTS

An embodiment of the present invention is explained in the following with reference to figures.

Figure 1:
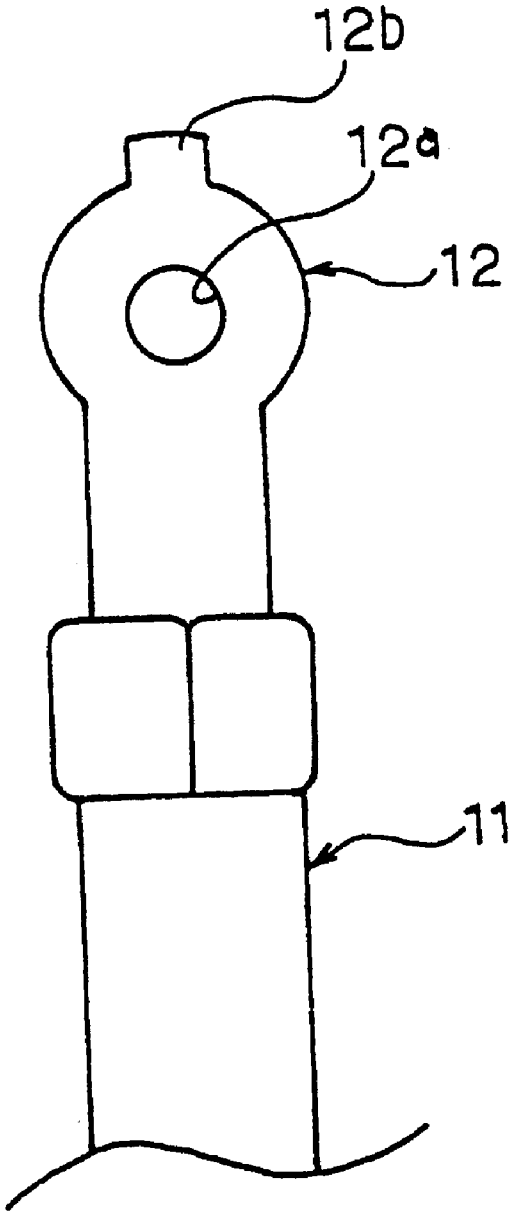
FIG. 1 is a plan view of an electric wire according to an embodiment of the present invention.
Figure 2A:
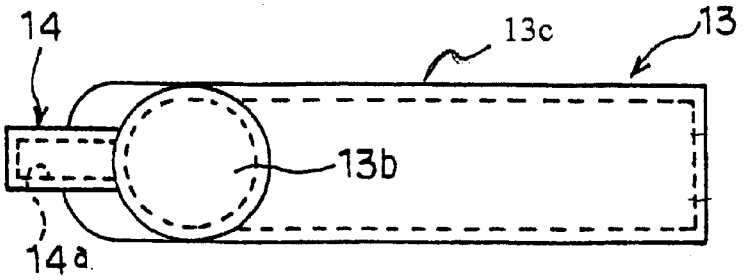
FIGS. 2(*a*)–2(*d*), respectively, are a top view, a side elevation view, a bottom view and a front elevation view of a terminal protective cap according to the embodiment of the present invention.
Figure 2B:
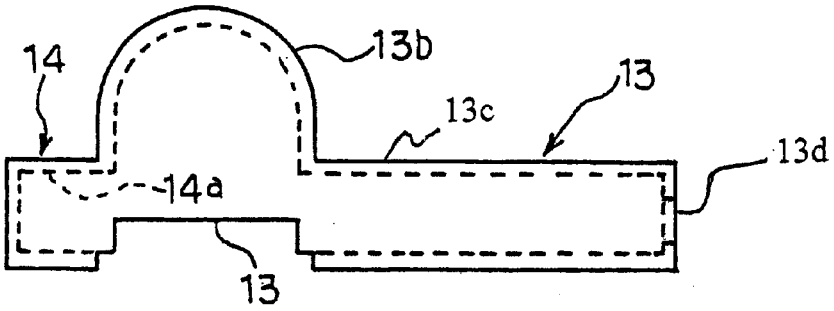
Figure 2C:
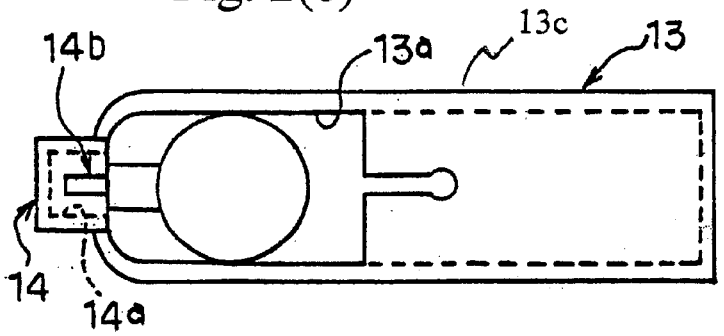
Figure 2D:
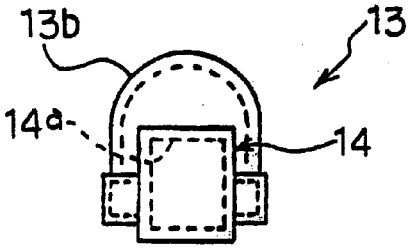
Figure 2E:
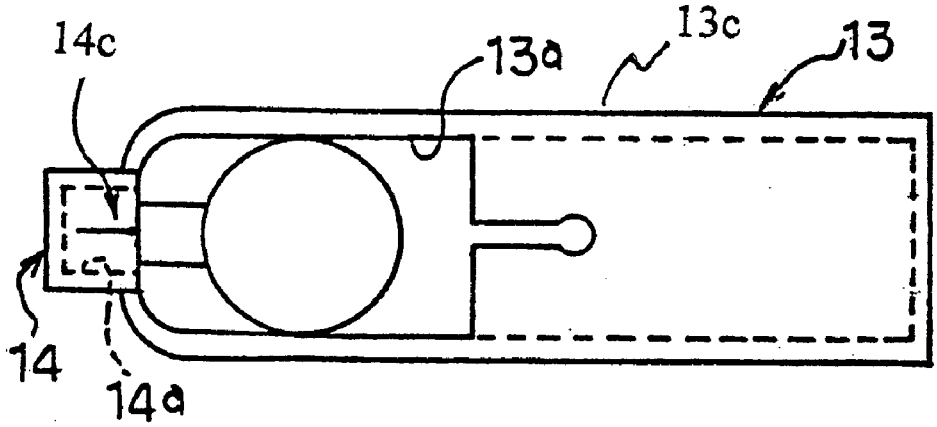
Figure 3:
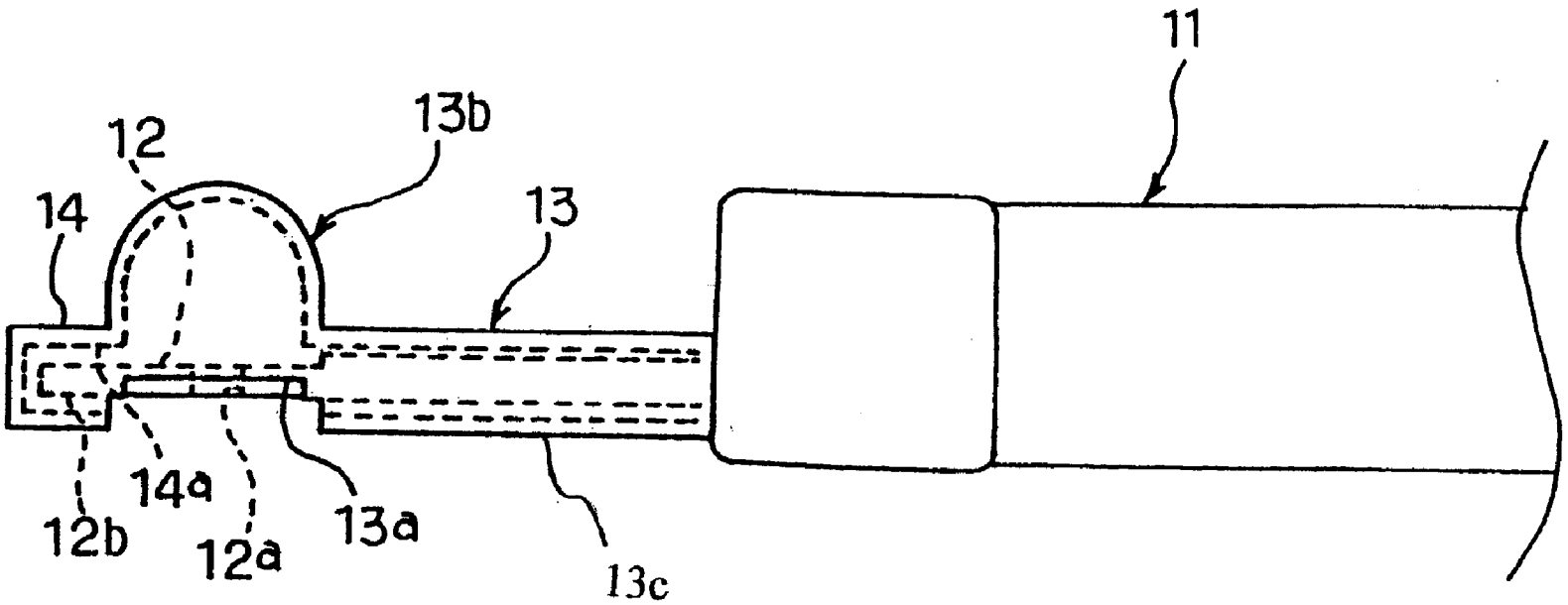
FIG. 3 shows a condition when the cap of the present invention covers the terminal.
Figure 4A:
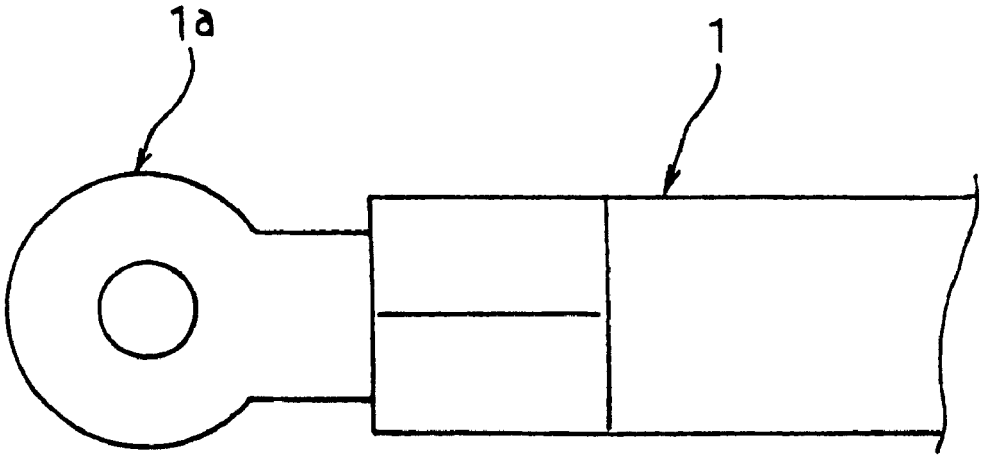
FIGS. 4(*a*) and 4(*b*), respectively, are a plan view of a conventional electric wire and a side elevation view of a conventional cap.
Figure 4B:
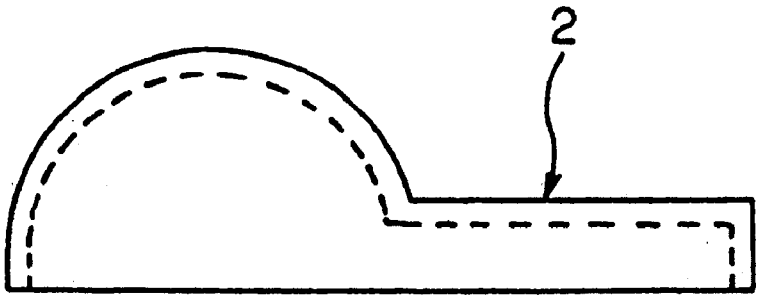
Prior Art Fig. 4(b)
Figure 5:
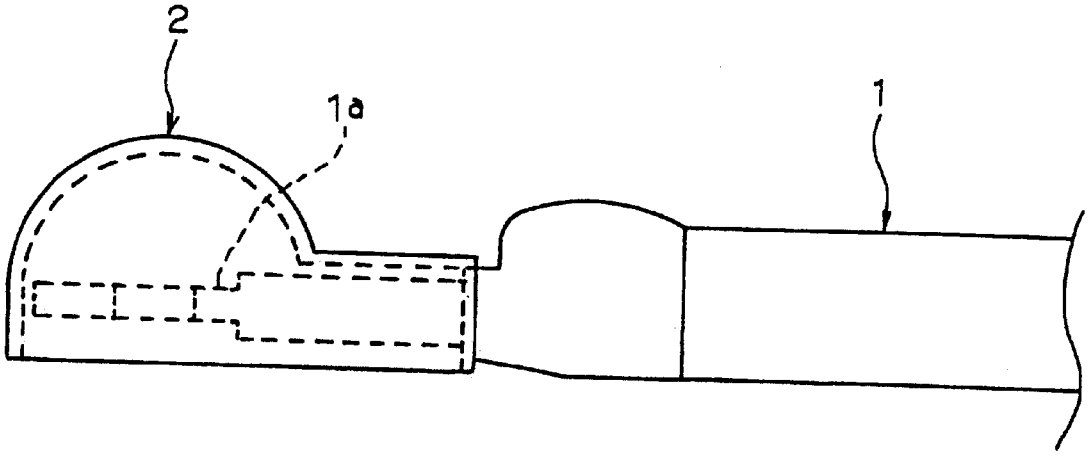
FIG. 5 shows a condition where the conventional cap covers the conventional terminal.

FIGS. 1 through 3 illustrate an embodiment of the terminal protective cap according to the present invention. First, a construction of the terminal protective cap is explained. In FIG. 1, an electric wire 11 is provided with a terminal 12. The terminal 12 has an insertion aperture 12*a* to receive a bolt (not shown). The terminal 12 also has a projecting portion 12*b* on the outer periphery.

FIGS. 2(*a*) through 2(*e*) show a cap 13, which is made of any suitable insulative elastic material, such as EPDM. The cap 13 has an opening 13*a*, a concave portion 13*b*, a hollow portion 13*c* and an opening 13*d*. The opening 13*d* is provided at a proximal end of the hollow portion 13*c*, and terminal 12 is inserted into the cap 13 through the opening 13*d*. The concave portion 13*b* is provided at the distal end of the hollow portion 13*c*. The opening 13*a* is provided at the bottom of the concave portion 13*b*. The terminal 12 is inserted into the cap so that the insertion aperture 12*a* is aligned with the opening portion 13*a*. Thus, a bolt can be inserted into the insertion aperture 12*a* of the terminal 12 and fixes the terminal 12 to an electrical component through the opening 13*a*. The concave portion 13*b* has sufficient height to cover the bolt when it is inserted to the insertion aperture 12*a* of the terminal 12.

The cap 13 has an engaging portion 14 at the distal end of the cap. The engaging portion 14 has an insertion hole 14*a* and a slot 14*b*, which is provided in the bottom side of the engaging portion 14. The projecting portion 12*b* is accommodated in the insertion hole 14*a* so as to engage with one another. The projecting portion 12*b* is inserted into the insertion hole 14*a* through the slot 14*b*. The engaging portion 14 can be provided at any position around the outer periphery of the concave portion 13*b*, as long as the position is aligned with the position of the projecting portion 12*b* of the terminal 12. Furthermore, instead of the slot 14*b*, a slit 14*c* in the material forming the bottom of the engaging portion 14 may be used (FIG. 2(*e*)). Thus, the projecting portion 12*b* can be pushed through the slot or slit for insertion into the engaging portion.

Next, the function of the terminal protective cap of the present invention is explained.

The terminal 12 is mounted to a starter motor (not shown) of an automobile, under the condition that the cap 13 is flipped over and the terminal 12 is exposed. After mounting, the cap is turned to cover the terminal 12. At this time, if the engaging portion 14 is pressed from the top, the engaging portion 14 around the slot 14*b* or slit 14*c* is deformed and the projecting portion 12*b* of the terminal 12 is inserted into the insertion hole 14*a* through the slot 14*b* or slit 14*c*. (FIG. 3)

As described above, in the embodiment of the present invention, since the projecting portion 12*b* of the terminal 12 engages with the engaging portion 14, the cap is prevented from inadvertent separation due to an external factor, such as vibrations. Thus, the terminal 12 is securely protected. Accordingly, the terminal 12 is prevented from being exposed and to being short-circuited.

In addition, the engaging portion 14 has the insertion hole 14*a* and a slot 14*b* (or slit 14*c*) so that the projecting portion 12*b* can be inserted into the insertion hole 14*a* through the slot 14*b* (or slit 14*c*). Therefore, the projecting portion 12*b* is inserted into the insertion hole 14*a* by pressing the engaging portion 14 from the top when the cap is being mounted on the terminal 12. Thus, the operability of the mounting task of the cap 13 improves.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. HEI 11-147840, filed on May 27, 1999, which is herein expressly incorporated by reference in its entirety.

What is claimed is:

1. A terminal protective cap configured to cover a terminal of an electric wire and to protect the terminal from exposure, the terminal having a portion connected to the electric wire, an insertion opening and a projecting portion positioned different from the portion connected to the electric wire, said terminal protective cap comprising:

a hollow portion having an opening at a proximal end thereof to receive the terminal;

a concave portion provided at a distal end of said hollow portion, said concave portion having an opening on the bottom and covering a retaining member when the retaining member is provided to pass through the insertion opening in the terminal and said opening of said concave portion;

an engaging portion projecting outwardly from said concave portion and engageable with the projecting portion projecting outwardly from an outer periphery of the terminal, said engaging portion including a hole to accommodate substantially the entire projecting portion and to cover substantially the entire bottom of the projecting portion and an opening through which the projecting portion of the terminal is inserted into said hole.

2. The terminal protective cap according to claim 1, wherein said opening of said engaging portion is provided in a bottom surface of said engaging portion.

3. The terminal protective cap according to claim 1, wherein said opening of said engaging portion comprises a slot.

4. The terminal protective cap according to claim 1, wherein said opening of said engaging portion comprises a slit.

5. The terminal protective cap according to claim 1, wherein said engaging portion is formed to have substantially the same shape as and to closely conform to the outer surface of the projecting portion.

6. The terminal protective cap according to claim 1, wherein the hollow portion forms a tubular shape without any opening in a peripheral surface thereof and having a size that allows the terminal to pass therethrough.

7. A method for mounting a terminal protective cap to a terminal having a projecting portion projecting outwardly from an outer periphery of the terminal and an insertion aperture to receive a retaining member inside the closed loop, the terminal protective cap having an engaging portion including a hole accommodating substantially the entire projecting portion, the method comprising:

inserting the terminal into the terminal protective cap;

aligning an insertion aperture provided in the terminal with an opening portion provided in a bottom of the terminal protective cap so that the retaining member can pass through the insertion aperture and the opening portion;

fixing the terminal to an electrical component by using the retaining member while the terminal protective cap is flipped over;

turning the terminal protective cap to cover the terminal with the retaining member; and pushing a top of an engaging portion so that the substantially entire projecting portion is accommodated in a hole provided in the engaging portion through an opening provided in a bottom of the engaging portion.

8. The method of claim 7, wherein the terminal protective cap includes a hollow portion formed as a continuous tubular shape without any opening in a peripheral surface thereof and having a size that allows the terminal to pass therethrough, and the inserting is performed by inserting the terminal into the terminal protective cap through hollow portion.

9. In combination with a terminal for an electric wire, said terminal including a portion connected to the electric wire, an insertion opening and a projecting portion on an outer periphery thereof and positioned different from the portion connected to the electric wire, a terminal protective cap that covers said terminal, said terminal protective cap comprising:

a hollow portion having an opening at a proximal end thereof to receive the terminal;

a concave portion provided at a distal end of said hollow portion, said concave portion having an opening on the bottom and covering a retaining member when the retaining member is provided to pass through the insertion opening in the terminal and said opening of said concave portion; and an engaging portion projecting outwardly from said concave portion from an outer periphery of said concave portion and being engageable with the projecting portion provided on the outer periphery of the terminal, said engaging portion including a hole to accommodate substantially the entire projecting portion and covering substantially entire bottom of the projecting portion and an opening through which the projecting portion of the terminal is inserted into said hole.

10. The terminal protective cap according to claim 9, wherein said opening of said engaging portion is provided in a bottom surface of said engaging portion.

11. The terminal protective cap according to claim 9, wherein said engaging portion is formed to have substantially the same shape as and to closely conform to the outer surface of the projecting portion.

* * * * *